United States Patent [19]

Scott

[11] 4,276,706

[45] Jul. 7, 1981

[54] POST AND PANEL SIGN ASSEMBLY

[76] Inventor: Albert Q. Scott, 922 N. Dutton Ave., Santa Rosa, Calif. 95401

[21] Appl. No.: 953,171

[22] Filed: Oct. 20, 1978

[51] Int. Cl.[3] ..... G09F 15/00

[52] U.S. Cl. ..... 40/607

[58] Field of Search ..... 403/246, 331, 230; 52/239; 40/605, 606, 607, 611

[56] References Cited

U.S. PATENT DOCUMENTS

| | | | |
|---|---|---|---|
| 1,483,067 | 2/1924 | Berry | 40/607 |
| 2,345,913 | 4/1944 | Bishop | 40/606 |
| 3,415,519 | 12/1968 | Hand | 40/606 |
| 3,525,493 | 8/1970 | Chrietzberger et al. | 40/606 |
| 3,529,798 | 9/1970 | Williams et al. | 40/607 |
| 3,552,702 | 1/1971 | Springer | 40/607 |
| 3,571,999 | 3/1971 | Downing | 52/38 X |
| 4,068,398 | 1/1978 | Parisi | 40/607 |

FOREIGN PATENT DOCUMENTS

| | | | |
|---|---|---|---|
| 1572960 | 5/1969 | France | 40/606 |

*Primary Examiner*—Gene Mancene
*Assistant Examiner*—Wenceslao J. Contreras
*Attorney, Agent, or Firm*—Flehr, Hohbach, Test, Albritton & Herbert

[57] ABSTRACT

Sign assembly having a generally planar panel mounted on one or more supporting posts. The panel is attached to the post by an interlocking cleat which is secured to the post and engaged by the frame of the panel in an interlocking relationship.

3 Claims, 4 Drawing Figures

POST AND PANEL SIGN ASSEMBLY

This invention pertains generally to sign assemblies and more particularly to a sign assembly of the post and panel type having a generally planar panel mounted on one or more supporting posts.

Post and panel signs are frequently constructed in modular form with interlocking elements manufactured by an extrusion process. Such signs are advantageous from the standpoint of light weight, low cost and adaptability to different sizes and shapes of signs. Heretofore, the posts for such signs have been formed with channels for receiving tongues which project from the sides of the panels. The channels extend the full length of the posts, and filler strips are mounted in the unused portions of the channels to provide a finished appearance. Since the channel is an integral part of the post and different posts are required for different sizes of signs, a sizable inventory of special posts is required.

The sign assembly of the invention utilizes a smooth post with a longitudinally extending cleat mounted thereon. The cleat is slidably received in the frame of the panel in an interlocking manner, and the panel is retained longitudinally on the post by a removable plate which abuts against one end of the cleat. The sign has a finished appearance without filler strips, and the same cleat can be utilized with posts of different sizes, eliminating the need for an inventory of special posts.

It is in general an object of the invention to provide a new and improved sign assembly of the post and panel type.

Another object of the invention is to provide a sign assembly of the above character having a cleat mounted on the post for interlocking engagement with the frame of the panel.

Additional objects and features will be apparent from the following description in which the preferred embodiment is set forth in detail in conjunction with the accompanying drawings.

Figure 1:
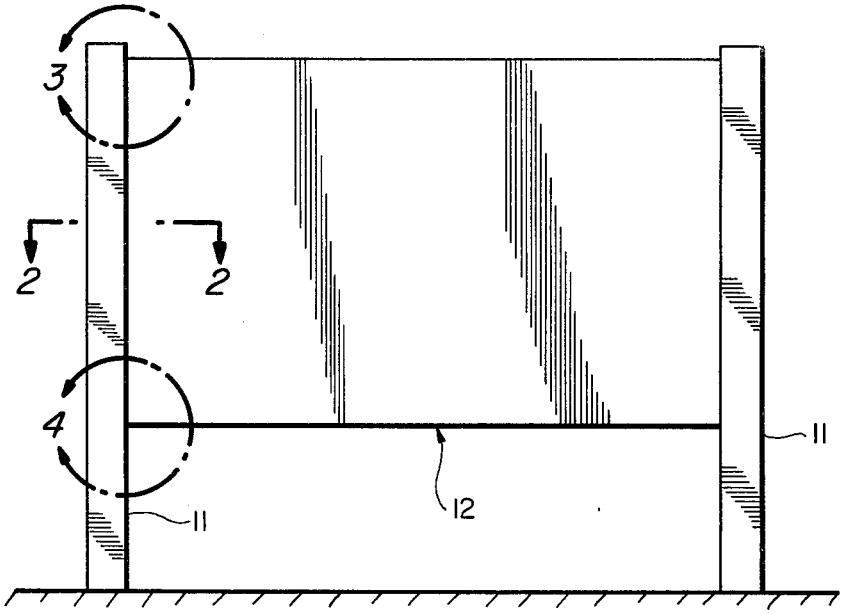
FIG. 1 is a front elevational view of one embodiment of a sign assembly according to the invention.
Figure 2:
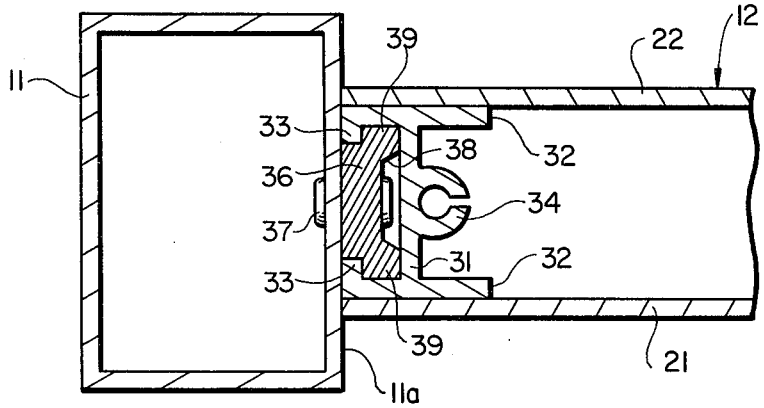
FIG. 2 is an enlarged fragmentary cross sectional view taken along line 2—2 in FIG. 1.
Figure 3:
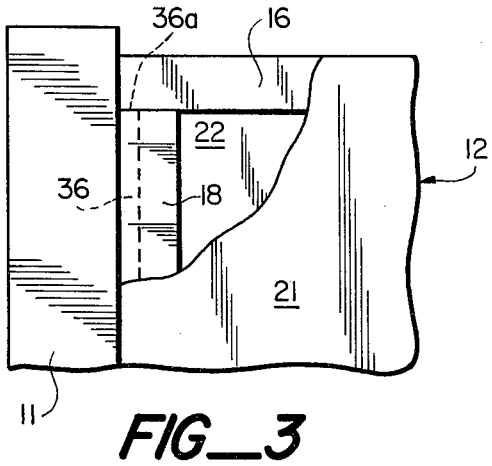
FIGS. 3 and 4 are enlarged fragmentary views, partly broken away, of portions of the sign assembly of FIG. 1.
Figure 4:
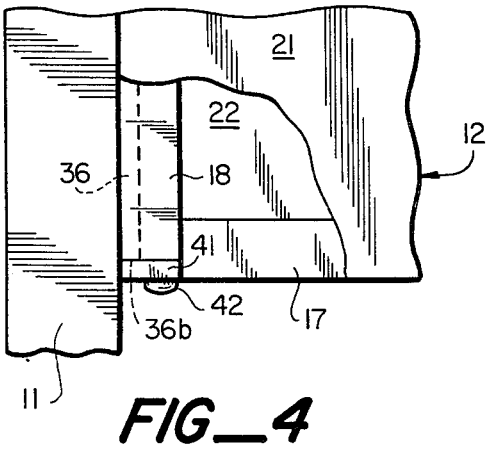

The sign assembly comprises a pair of upright posts 11 and a panel assembly 12 mounted on the posts. In the embodiment illustrated, the posts are fabricated of a rectangular box tubing such as extruded aluminum, but it will be understood that other materials and types of posts can be utilized. One advantage of the invention, however, is that the surface 11*a* of the post on which the panel assembly is mounted can be smooth and planar, without the channels required in post and panel signs heretofore provided.

The panel assembly includes a generally rectangular frame comprising a top frame member 16, a bottom frame member 17, and side frame members 18. Generally planar front and rear panels 21,22 are mounted on the front and rear surfaces of the frame and are affixed thereto to form an integral structure. Information to be displayed by the sign is applied to the outer surfaces of the panels in a conventional manner.

In the preferred embodiment, frame members 16,17 are fabricated of box tubing of a suitable material such as extruded aluminum. Side frame members 18 are also fabricated by an extrusion process, and have a generally I-shaped cross section, with a web portion 31 and flanges 32. Lips 33 project inwardly from the flanges at the sides of the panel assembly. The web includes a longitudinally extending boss 34 of generally annular cross section for receiving screws threadedly inserted therein.

Elongated cleats 36 are mounted on the smooth surfaces 11*a* of the posts. The cleats extend longitudinally of the posts and are fixedly secured thereto by suitable fasteners such as screws or rivets 37. Each of the cleats includes a channel 38 which opens away from the post and receives the heads of the mounting screws or rivets in a recessed manner. The cleats also include longitudinally extending, laterally projecting flanges 39 which interlock with the side frame members of the panel assembly when the frame members are slidably mounted on the cleats. Flanges 39 are spaced from the mounting surface of the post, and lips 33 are received in the slots which are formed between the flanges and the post. Likewise, lips 33 are spaced from web 31, and flanges 39 are received in the channels formed between the lips and web.

Means is provided for holding the panel assembly longitudinally in position on the posts. In this regard, upper frame member 16 extends across the upper end of side frame members. 18 and rests in abutting engagement on the upper ends 36*a* of the cleats. At the bottom of the panel assembly, retaining plates 41 abut against the lower ends 36*b* of the cleats. The retaining plates are removably secured to the lower ends of frame members 18 by screws 42 which are threadedly inserted in bosses 34. Lower frame member 17 abuts against the inner sides of side frame members 18, and the lower ends of the side frame members are recessed above the lower surface of the bottom frame member. The retaining plates are mounted in these recesses and are not visible except from below the panel assembly. The heads of screws 42 can be recessed into the retaining plates, if desired.

Operation and use of the sign assembly can now be described. The panel portion of the assembly is constructed as a unit, and the desired lettering or other information is applied to the outer surfaces of the panels. The cleats are cut the same length as the side frame members of the panel assembly and mounted in the desired position on the posts. In the embodiment illustrated, the panel assembly is offset a small distance below the tops of the posts, but the panel can be positioned at any desired height on the posts. Once the cleats are mounted on the posts, the panel assembly is slid longitudinally down over the cleats until the lower surface of upper frame member 16 abuts against the upper ends of the cleats. Retaining plates 41 are then installed and secured by screws 42, and the sign is ready for installation in the desired location.

The sign assembly has a number of important features and advantages. It is lightweight and rugged, and it can be manufactured and assembled quickly and economically. the mounting cleat can be utilized with a wide variety of posts and eliminates the need for an inventory of complex extrusions for different sizes of signs. Only one fastener is required at each end of the sign, and these can be concealed from view if desired.

It is apparent from the foregoing that a new and improved sign assembly has been provided. While only one presently preferred embodiment has been described in detail, as will be apparent to those familiar with the art, certain changes and modifications can be made without departing from the scope of the invention as defined by the following claims.

What is claimed is:

1. In a sign assembly: an elongated post having a smooth outer surface, an elongated cleat mounted on the outer surface of the post and extending less than the full length of the post, a panel having a first side frame member slidably mounted on the cleat in interlocking engagement therewith and a second frame member abutting against one end of the cleat, and a retaining plate removably secured to the first frame member and abutting against the other end of the cleat.

2. The claim assembly of claim 1 wherein the cleat includes a pair of outwardly projecting flanges and the side frame member of the panel includes a channel with inwardly protruding lips for receiving said flanges.

3. In a sign assembly: a vertically extending post having a smooth outer surface, a vertically extending cleat mounted on the outer surface of the post, a panel having an elongated side member slidably mounted on the cleat in interlocking engagement therewith, said panel also including an upper frame member which overlies and abuts against the upper end of the cleat, and a plate which abuts against the lower end of the cleat and is removably secured to the lower end of the side frame member.

* * * * *